US005399008A

United States Patent [19]

Vann, Jr.

[11] Patent Number: 5,399,008

[45] Date of Patent: Mar. 21, 1995

[54] MEDICINE CABINET WITH DOUBLY HINGED MIRROR ASSEMBLY

[76] Inventor: John C. Vann, Jr., 17315 Peach, Irvine, Calif. 92715

[21] Appl. No.: 45,928

[22] Filed: Apr. 12, 1993

[51] Int. Cl.[6] ..... A47B 67/00

[52] U.S. Cl. ..... 312/227; 312/242; 312/329; 49/163; 49/168

[58] Field of Search ..... 312/226, 227, 242, 329; 49/98, 104, 163, 168

[56] References Cited

U.S. PATENT DOCUMENTS

| | | | |
|---|---|---|---|
| 1,078,502 | 11/1913 | Wardrobe . | |
| 1,088,765 | 3/1914 | Booth . | |
| 2,290,035 | 7/1942 | Conwell | 312/329 X |
| 2,489,418 | 11/1949 | Jones | 312/329 X |
| 2,557,037 | 6/1951 | Rooney . | |
| 2,763,186 | 9/1956 | Barlow . | |
| 2,783,115 | 2/1957 | York | 312/329 X |
| 3,140,134 | 7/1964 | Nairn | 312/227 X |
| 3,176,942 | 4/1965 | Mitchell et al. . | |
| 3,771,854 | 11/1973 | Roark . | |
| 3,909,091 | 9/1975 | Tantillo | 312/227 X |
| 4,396,249 | 8/1983 | Aisley . | |

*Primary Examiner*—Brian K. Green
*Attorney, Agent, or Firm*—Macro-Search Corp.

[57] ABSTRACT

A medicine cabinet for mounting in a wall recess in a wall is disclosed. A cabinet unit has side, top, and a bottom panels arranged in a box construction for mounting into the wall recess. An open rectangular front frame is an extension of the panels and provides access to a storage space within the cabinet unit. The front frame protrudes outwardly from the wall for presenting a front cabinet face parallel to the wall. The medicine cabinet further includes a door assembly for closing against the front cabinet face and for covering the storage space. The door assembly comprises a swinging door frame with both a rear surface and a front surface, and a mirrored door with both a rear surface and a front, mirrored surface. The swinging door frame is a rectangular open box of approximately the same size and shape as the front frame, and is hingably mounted to the front frame by a first hinge at one side of the front frame. The mirrored door fully covers the swinging door frame, and is hingably mounted to the swinging door frame by a second hinge. The swinging door frame includes a first latch for maintaining closure of the swinging door frame against the front frame, and a second latch for maintaining closure of the mirrored door against the front surface of the swinging door frame.

4 Claims, 4 Drawing Sheets

MEDICINE CABINET WITH DOUBLY HINGED MIRROR ASSEMBLY

FIELD OF THE INVENTION

This invention relates generally to cabinets and, more particularly, is directed towards a novel wall-mounted medicine cabinet.

BACKGROUND OF THE INVENTION

Conventional medicine cabinets include a cabinet structure and a hinged door structure that typically includes a mirror on its outer surface. It is not uncommon for such a cabinet to be placed on or within a wall that is adjacent and perpendicular to a larger wall mirror over a bathroom counter, such that the hinge of the door is near the wall mirror. In such an installation, the mirrored door may be readily pivoted away from the cabinet, thereby allowing easy access to the contents of the cabinet without fully opening the door. Further, as the mirrored door is opened it moves towards parallel alignment with the wall mirror, thereby presenting different angles of a person's reflected image and allowing the person to see, depending upon where he looks and the position of the mirrored door, different perspectives of his face.

Such conventional medicine cabinets, however, are difficult to use for close-up observation of one's face. With the installation previously described, the person must lean over the bathroom counter to get his face close to the mirrored door or to the larger wall mirror. Further, the different perspectives of the person's face that are available are limited. For example, the person cannot see the back of his head without using an additional hand-held mirror, or the like. Such conventional medicine cabinets have further drawbacks. For example, such a cabinet can only be opened from one side.

A variety of other cabinets have been developed to overcome some of the difficulties with the conventional medicine cabinet. For example, U.S. Pat. No. 2,557,037 to Rooney on Jun. 12, 1951, teaches a medicine cabinet hinged to an X-shaped support that is, in turn, hinged to a mirrored door. Such a cabinet, however, cannot be opened and accessed from either side since the X-shaped support blocks access to the contents of the cabinet if opened from one side. Further, if opened from the one side the latch mechanism on the other side automatically releases, causing the X-shaped support and the mirrored door to swing away from the cabinet inconveniently.

Another prior art type of cabinet is disclosed in U.S. Pat. No. 4,396,249 to Aisley on Aug. 2, 1983. Such a device, while allowing access to the cabinet from either side, has a hinge element 20 that prevents the mounting of such a cabinet in a recess in a wall such that the mirror is flush with the wall. Such a device, therefore, is not suitable for installations where the mirror is to be installed flush with the wall, which is becoming a more and more popular method of installing such mirrors.

Clearly, then, there is a need for a mirrored cabinet device that allows access to the cabinet from either side. Such a needed device would still operate as intended when installed with the mirror flush with the wall. Further, such a needed device, even when opened, would be aesthetically pleasing, and when used in conjunction with a wall mirror would allow one to observe one's posterior side. Still further, such a device would be relatively simple to manufacture, durable, and easy to clean and maintain. The present invention fulfills these needs and provides further related advantages.

SUMMARY OF THE INVENTION

The present invention is a medicine cabinet for mounting in a wall recess in a wall. A cabinet unit has side, top, and a bottom panels arranged in a box construction for mounting into the wall recess. An open rectangular front frame is an extension of the panels and provides access to a storage space within the cabinet unit. The front frame protrudes outwardly from the wall for presenting a front cabinet face parallel to the wall. The medicine cabinet further includes a door assembly for closing against the front cabinet face and for covering the storage space. The door assembly comprises a swinging door frame with both a rear surface and a front surface, and a mirrored door with both a rear surface and a mirrored surface. The swinging door frame is a rectangular open box of approximately the same size and shape as the front frame, and is hingably mounted to the front frame by a first hinge at one side of the front frame. The mirrored door is of a size to fully cover the swinging door frame, and is hingably mounted to the swinging door frame by a second hinge. As such, the mirrored door swings pivotally away from the door frame about the second hinge from the other side of the front frame. The swinging door frame includes a first latch for maintaining closure of the swinging door frame against the front frame, and a second latch for maintaining closure of the mirrored door against the front surface of the swinging door frame.

In use, with the swinging door frame closed against the front frame, and with the mirrored door closed against the swinging door frame, the door assembly may be pivoted about the first hinge to gain access to the storage space through the front frame. Likewise, with the swinging door frame closed against the front frame, and with the mirrored door closed against the swinging door frame, the mirrored door may be pivoted about the second hinge means to gain access to the storage space through the door frame and the front frame. As such, access to the storage space may be gained from either side of the medicine cabinet. Further, a wall mirror positioned at a right angle to the front cabinet face may be used in combination with the medicine cabinet such that with the door frame rotated from the closed position by at least 90 degrees, and with the mirrored door rotated from the dosed position against the door frame by at least 180 degrees, the mirror surface of the mirrored door may be positioned in approximately parallel facing alignment with the wall mirror so that it is possible to view the posterior of one's body by standing between the wall mirror and the mirror surface.

The present invention is a mirrored cabinet device that allows unhindered access to the contents of the cabinet from either side. The present device is completely functional even when installed with its mirror surface flush with the wall. Further, the present invention, even when opened, is aesthetically pleasing, and when used in conjunction with a wall mirror allows one to observe one's posterior side. Still further, the present invention is relatively simple to manufacture, durable, and easy to clean and otherwise maintain. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
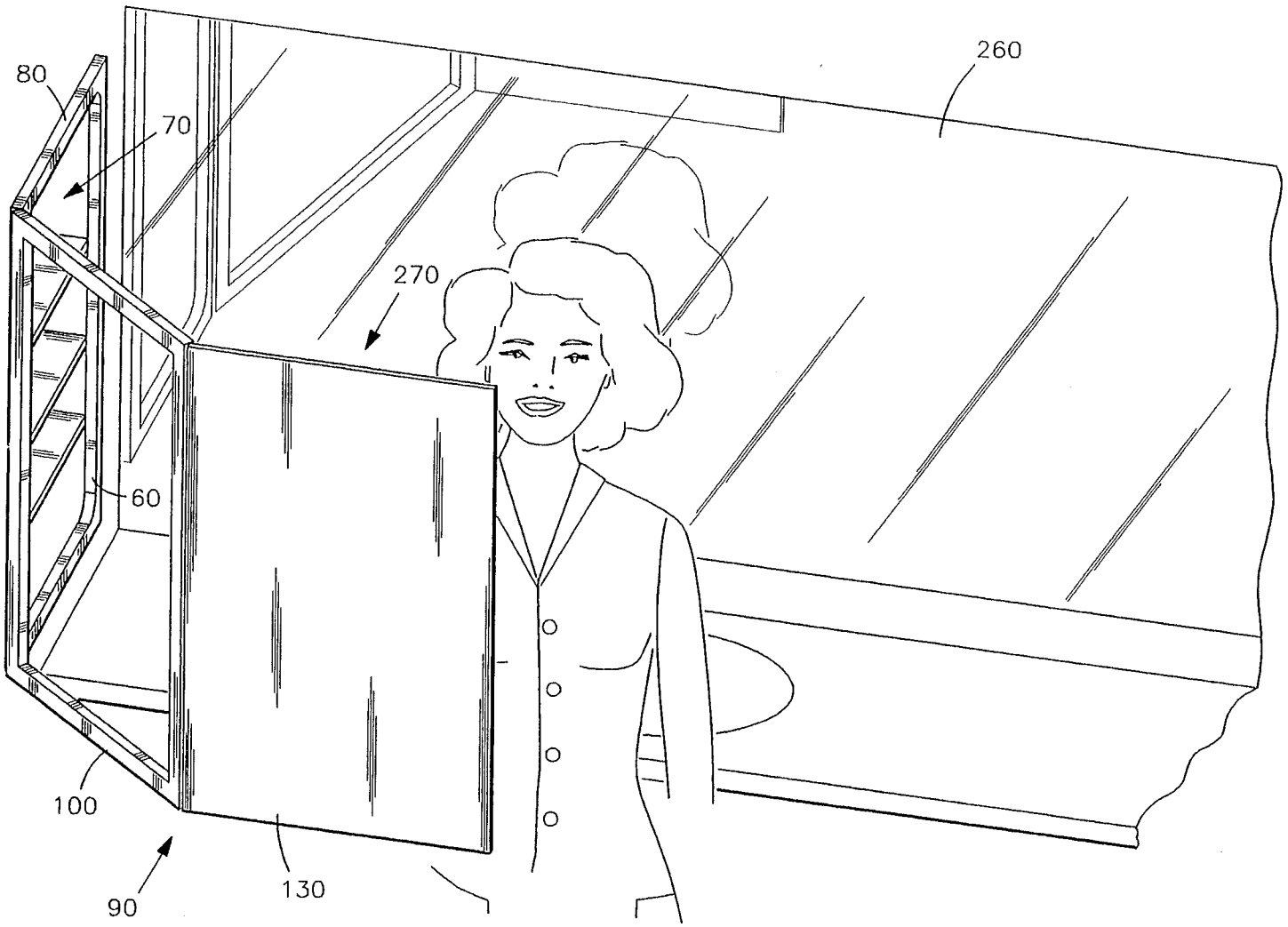
FIG. 1 is a perspective illustration of the invention, illustrating a cabinet unit of the invention hung on a wall, and a door assembly with a door frame and a mirrored door.
Figure 2:
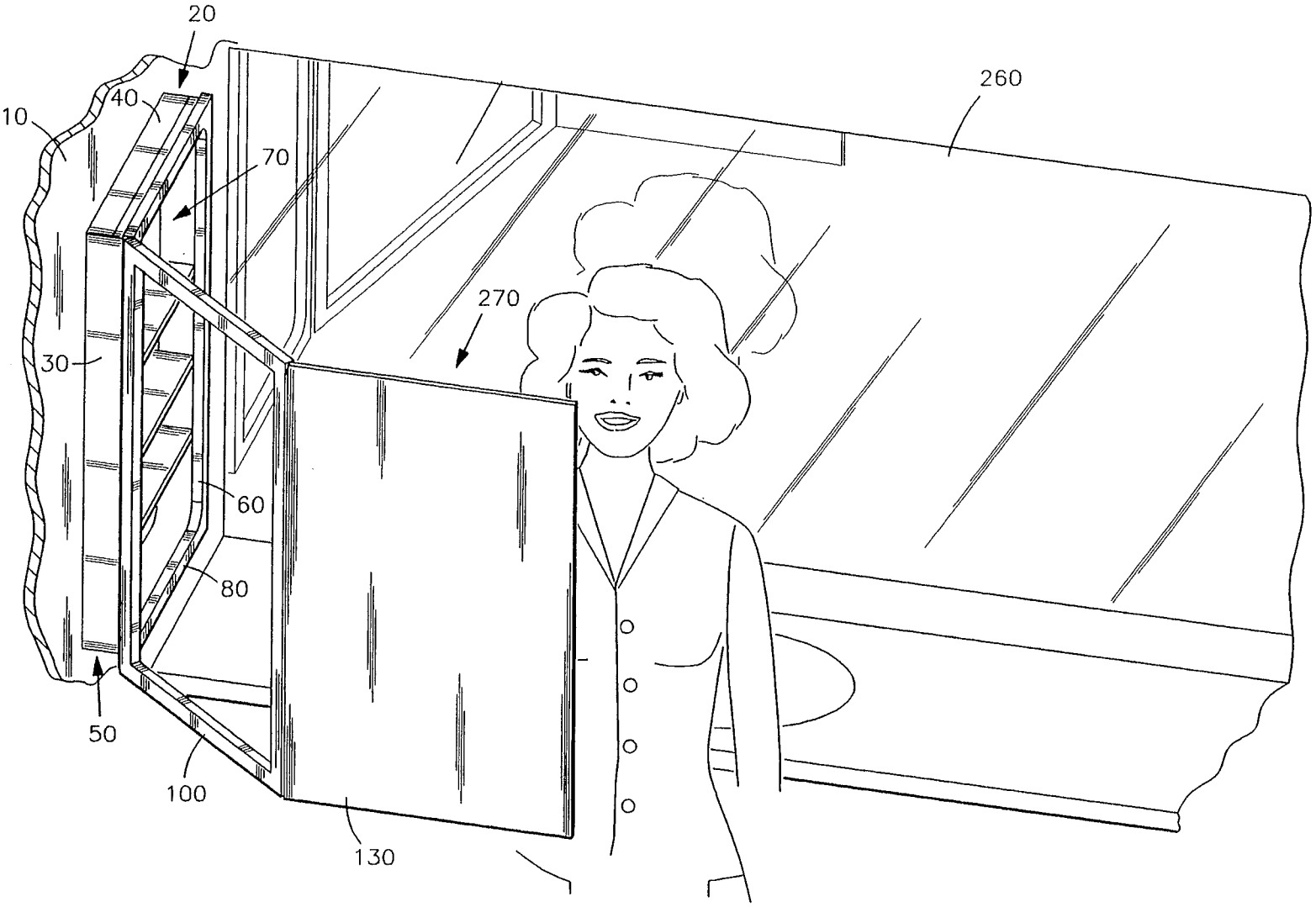
FIG. 2 is a perspective, partially cut-away illustration of the invention, illustrating an embodiment wherein the cabinet unit is mounted into a recess in the wall.
Figure 3:
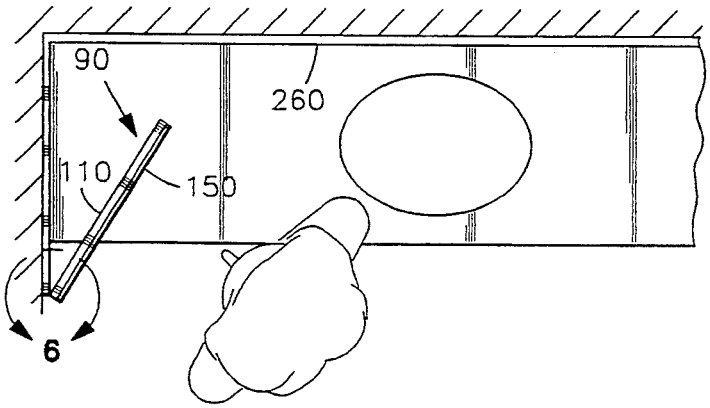
FIG. 3 is a top plan view of the invention, illustrating the door assembly pivoted slightly from a closed position against the front frame such that a person may use a mirrored surface of the mirrored door.

FIGS. 1 and 2 illustrates a medicine cabinet for mounting on a wall 10, and for mounting in a wall recess in a wall 10, respectively. A cabinet unit 20 has side panels 30, a top panel 40, and a bottom panel 50 arranged in a box construction for mounting into the wall recess. An open rectangular outfacing edge of the panels 30,40,50 provides access to a storage space 70 within the cabinet unit 20. The out facing edge 60 protrudes outwardly from the wall 10 for presenting a front cabinet face 80 parallel to the wall 10. The panels 30,40,50 are made from a thin rigid material, such as sheet metal. The cabinet unit 20 may also includes a number of shelves.

The medicine cabinet further induces a door assembly 90 for dosing against the front cabinet face 80 and covering the storage space 70. The door assembly 90 comprises a swinging door frame 100 with both a rear surface 110 and a front surface 120, and a mirrored door 130 with both a rear surface 140 and a mirrored surface 150. The door frame 100 is preferably made from a rigid material, such as metal, wood, or plastic.

Figure 6:
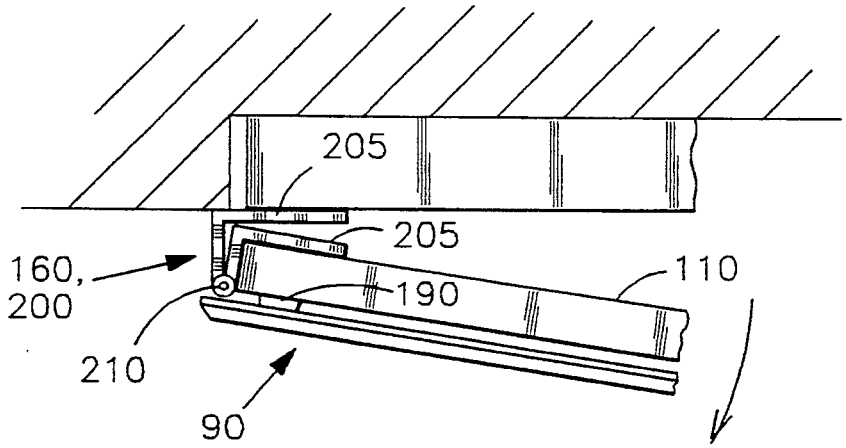
FIG. 6 is a partial top plan view of the invention, taken generally along line 6 of FIG. 3, and illustrating a first hinge means and flush mounting of the cabinet unit within a recess of the wall.

The swinging door frame 100 is a rectangular open box of approximately the same size and shape as the outfacing edge 60, and is hingably mounted to the outfacing edge 60 by a first hinge means 160 at one side of the outfacing edge 60. As such, the swinging door frame 100 swings pivotally away from the front cabinet face 80 about the first hinge means 160 from the one side of the outfacing edge 60. The first hinge means 160 includes at least one a pair of first L-shaped legs 205 fixedly attached to the front cabinet face 80 and to the adjacent door frame 100 respectively (FIG. 6). A hinge pin 210 pivotally joins the first L-shaped legs 205 at one end of each leg 205. The hinge pin 210 is positioned just behind the mirrored door 130 such that the door assembly 90 will rotate from the closed position by at least 180 degrees to place the mirrored surface 150 of the mirrored door 130 in approximately the same plane as the front cabinet face 80, thereby providing clearance for the door assembly 90 to swing a full 180 degrees when the front cabinet face 80 is flush with the wall 10.

The mirrored door 130 is of a size to fully cover the swinging door frame 100, and is hingably mounted to the swinging door frame 100 by a second hinge means 170. As such, the mirrored door 130 swings pivotally away from the door frame 100 about the second hinge means 170 from the other side of the outfacing edge 60. The second hinge means 170 includes at least one pair of second L-shaped legs 240 fixedly attached to the outward facing surface of the door frame 100 and to the rear surface 140 of the mirrored door 130 respectively. A second hinge pin 250 pivotally joins the second L-shaped legs 240 at one end of each leg 240. The second hinge pin 250 is positioned just behind the rear surface of the door frame 100 such that the mirrored door 130 will rotate by up to 270 degrees to place the mirrored surface 150 in the same plan as the front cabinet face 80, enabling the cabinet to be flush mounted to the wall 10 and so that the mirror surface 150 may be positioned as shown in FIGS. 1 and 2.

Figure 4:
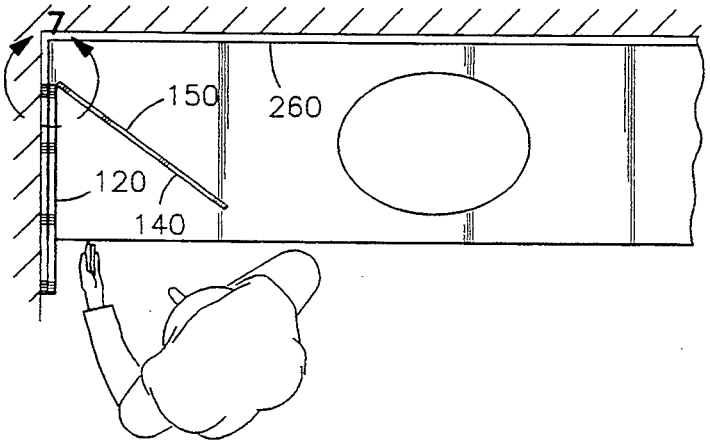
FIG. 4 is a top plan view of the invention, illustrating the door assembly in the closed position, and the mirrored door pivoted slightly from a closed position against the door frame such that the person may gain access to a storage space within the cabinet unit.
Figure 7:
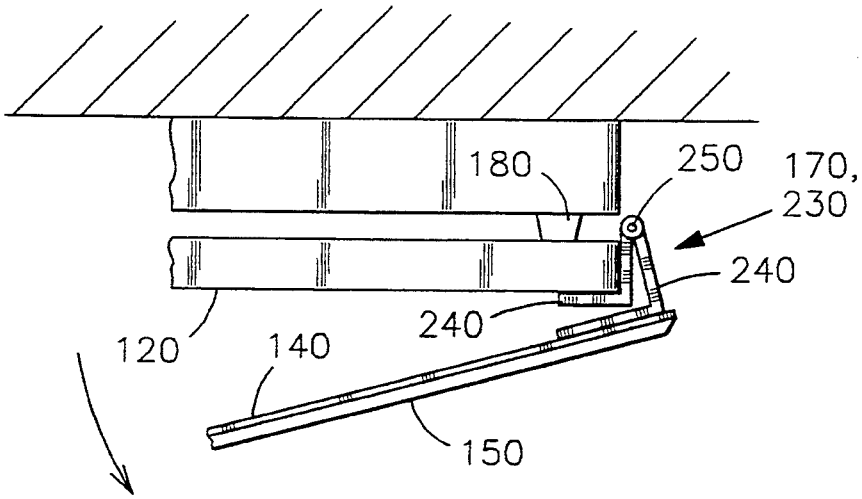
FIG. 7 is a partial top plan view of the invention, taken generally along line 7 of FIG. 4, and illustrating a second hinge means.

The swinging door frame 100 includes a first latching means 180 for maintaining closure of the swinging door frame 100 against the outfacing edge 60 (FIG. 7), and second latching means 190 for maintaining closure of the mirrored door 130 against the front surface of the swinging door frame 100 (FIG. 6). As such, with the swinging door frame 100 dosed against the outfacing edge 60, and with the mirrored door 130 dosed against the swinging door frame 100, the door assembly 90 may be pivoted about the first hinge means 160 to gain access to the storage space 70 through the outfacing edge 60 (FIG. 2). Likewise, with the swinging door frame 100 closed against the outfacing edge 60, and with the mirrored door 130 closed against the swinging door frame 100, the mirrored door 130 may be pivoted about the second hinge means 170 to gain access to the storage space 70 through the door frame 100 and the outfacing edge 60 (FIG. 4). As such, access to the storage space 70 may be gained from either side of the medicine cabinet.

Figure 5:
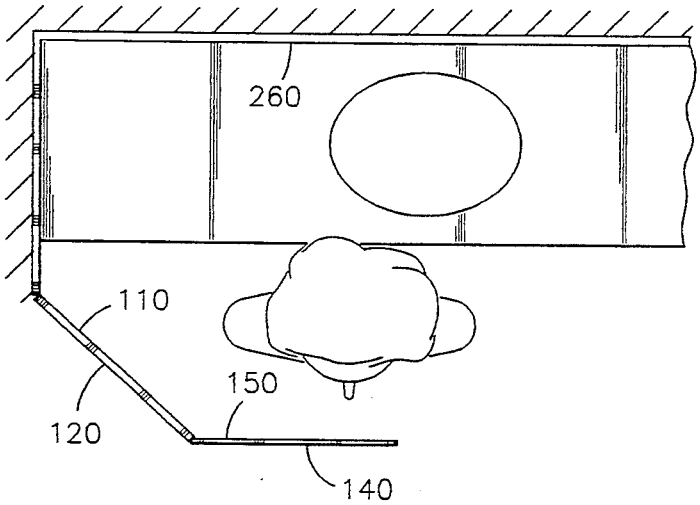
FIG. 5 is a top plan view of the invention, illustrating the door assembly and the mirrored door both rotated from their closed positions such that the person may view the posterior of the body by observing the doubly reflected image thereof from the mirrored surface and forms a wall mirror.

A wall mirror 260 positioned at a right angle to the front cabinet face 80 may be used in combination with the medicine cabinet such that with the door frame 100 rotated from the dosed position by at least 90 degrees, and with the mirrored door 130 rotated from the closed position against the door frame 100 by at least 180 degrees, the mirrored door 130 may be positioned in approximately parallel alignment 220 with the wall mirror 260 so that it is possible to view the posterior of one's body by standing between the wall mirror 260 and the mirror surface 150 (FIG. 5). In such an installation, the cabinet may be installed either to the left of the wall mirror 260, as illustrated in FIGS. 1 and 2, or to the right of the wall mirror 260 by rotating the cabinet 180 degrees in the plane of the front cabinet face 80, the appearance of which is understood to be the mirror image of FIGS. 1 and 2.

While the invention has been described with reference to a preferred embodiment, it is to be dearly understood by those skilled in the art that the invention is not limited thereto. For example, a locking mechanism could be included to prevent either the mirrored door 130 or the door frame 100 from opening (not shown). Thus, the scope of the invention is to be interpreted only in conjunction with the appended claims.

What is claimed is:

1. A medicine cabinet for mounting flush in a wall recess of a wall comprising:

a cabinet unit having a pair of side panels, a top panel and a bottom panel arranged in a box construction for placement within the wall recess and defining a storage space therein, the panels providing an outfacing rectangular edge encompassing the side, top and bottom panels;

a door assembly, hingably mounted to the cabinet unit and closing thereagainst so as to cover the storage space, and further comprising:

a swinging door frame of rectangular open box form with a rear surface, a front surface and an outer peripheral edge, the rear surface hingably mounted to the edge of one of the side panels, by a first hinge means, providing at least one pair of first L-shaped legs, the legs being fixedly attached to one of the side panels and to the rear surface of the door frame respectively; at least one first hinge pin pivotally joining the legs at a first position adjacent the peripheral edge of the door frame, the L-shaped legs providing a means for allowing the door frame to rotate open in a rotational direction by at least 180 degrees;

a mirrored door with opposing rear and mirrored surfaces, of a size to fully cover the swinging door frame, the rear surface hingably mounted to the front surface of the door frame by a second hinge means providing at least one pair of second L-shaped legs, fixedly attached to the front surface of the door frame, and to the rear surface of the door respectively, at least one second hinge pin pivotally joining the legs at a second position adjacent the peripheral edge of the door frame, the L-shaped legs providing a means for allowing the mirrored door to rotate open by up to 270 degrees in an alternate rotational direction opposing the rotational direction of the door frame;

such that with the swinging door frame closed against the outfacing rectangular, and with the mirrored door closed against the swinging door frame, the door assembly is pivotable about the first hinge means to gain access to the storage space, the mirrored door is pivotable about the second hinge means to gain access to the storage space through the swinging door frame, and with the door frame and the mirrored door both pivoted open improved positioning of the mirrored surface is provided.

2. The medicine cabinet for mounting in a recess in a wall of claim 1 used in combination with a wall mirror positioned at a right angle to the outfacing rectangular edge of the panels, wherein with the door frame rotated from closed position by at least 90 degrees, and with the mirrored door rotated from closed position against the door frame, by at least 180 degrees, the mirrored door may be positioned in approximately parallel alignment with the wall mirror so as to view the posterior of ones body when it is positioned between the wall mirror and the mirror surface.

3. A medicine cabinet for mounting on a wall comprising:

a cabinet unit having a pair of side panels, a top panel and a bottom panel arranged in a box construction defining a storage space therein, the panels providing an outfacing rectangular edge encompassing the side, top and bottom panels;

a door assembly, hingably mounted to the cabinet unit and closing thereagainst so as to cover the storage space, and further comprising:

a swinging door frame of rectangular open box form with a rear surface, a front surface and an outer peripheral edge, the rear surface hingably mounted to the edge of one of the side panels, by a first hinge means, providing at least one pair of first L-shaped legs, the legs being fixedly attached to one of the side panels and to the rear surface of the door frame respectively; at least one first hinge pin pivotally joining the legs at a first position adjacent the peripheral edge of the door frame, the L-shaped legs providing a means for allowing the door frame to rotate open in a rotational direction by at least 180 degrees;

a mirrored door with opposing rear and mirrored surfaces, of a size to fully cover the swinging door frame, the rear surface hingably mounted to the front surface of the door frame by a second hinge means providing at least one pair of second L-shaped legs, fixedly attached to the front surface of the door frame, and to the rear surface of the door respectively, at least one second hinge pin pivotally joining the legs at a second position adjacent the peripheral edge of the door frame, the L-shaped legs providing a means for allowing the mirrored door to rotate open by up to 270 degrees in an alternate rotational direction opposing the rotational direction of the door frame;

such that with the swinging door frame closed against the outfacing rectangular edge, and with the mirrored door closed against the swinging door frame, the door assembly is pivotable about the first hinge means to gain access to the storage space, the mirrored door is pivotable about the second hinge means to gain access to the storage space through the swinging door frame, and with the door frame and the mirrored door both pivoted improved positioning of the mirrored surface is provided.

4. The medicine cabinet of claim 3 used in combination with a wall mirror positioned at a right angle to the outfacing rectangular edge of the panels, wherein with the door frame rotated from closed position by at least 90 degrees, and with the mirrored door rotated from closed position against the door frame, by at least 180 degrees, the mirrored door may be positioned in approximately parallel alignment with the wall mirror so as to view the posterior of ones body when it is positioned between the wall mirror and the mirror surface.

* * * * *